US009187227B2

(12) United States Patent
Bradford

(10) Patent No.: US 9,187,227 B2
(45) Date of Patent: Nov. 17, 2015

(54) BLISTER PACKAGE WITH TIERED ROWS OF PRODUCTS

(71) Applicant: Energizer Brands, LLC, St. Louis, MO (US)

(72) Inventor: Andrew G. Bradford, Asheboro, NC (US)

(73) Assignee: Energizer Brands, LLC, Saint Louis, MO (US)

( * ) Notice: Subject to any disclaimer, the term of this patent is extended or adjusted under 35 U.S.C. 154(b) by 0 days.

(21) Appl. No.: 14/248,626

(22) Filed: Apr. 9, 2014

(65) Prior Publication Data

US 2015/0291331 A1 Oct. 15, 2015

(51) Int. Cl.

| | |
|---|---|
| ***B65D 85/00*** | (2006.01) |
| ***B65D 75/36*** | (2006.01) |
| ***B65D 85/20*** | (2006.01) |
| ***B65D 73/00*** | (2006.01) |
| ***B65D 73/02*** | (2006.01) |

(52) U.S. Cl.

CPC ..... *B65D 75/368* (2013.01); *B65D 73/0064* (2013.01); *B65D 73/02* (2013.01); *B65D 85/20* (2013.01)

(58) Field of Classification Search

CPC ..... B65D 2585/88; B65D 75/36

USPC ..... 206/703, 705, 756, 761, 461, 462, 467, 206/470, 471

See application file for complete search history.

(56) References Cited

U.S. PATENT DOCUMENTS

| | | | | |
|---|---|---|---|---|
| 1,030,209 | A | 6/1912 | Schandein | |
| 2,517,030 | A | 8/1950 | Ringler | |
| 2,857,881 | A * | 10/1958 | Beebe et al. | 30/454 |
| 2,985,296 | A * | 5/1961 | Kahn | 206/470 |
| 3,254,759 | A * | 6/1966 | Britton | 206/756 |
| 4,531,637 | A | 7/1985 | Cusmano | |
| 4,958,731 | A * | 9/1990 | Calcerano | 206/705 |
| 5,497,882 | A * | 3/1996 | Kenyon | 206/485 |
| D446,715 | S | 8/2001 | Humphrey | |
| D577,992 | S * | 10/2008 | Sutker et al. | D9/418 |
| 7,571,813 | B2 * | 8/2009 | Weisskopf | 206/755 |
| 8,328,016 | B2 * | 12/2012 | Thornton et al. | 206/465 |
| 8,616,372 | B2 * | 12/2013 | Wills | 206/462 |
| 2006/0000738 | A1 * | 1/2006 | Kumakura et al. | 206/470 |

FOREIGN PATENT DOCUMENTS

| | | |
|---|---|---|
| GB | 482530 | 3/1938 |
| JP | 2004136922 A | 5/2004 |

* cited by examiner

*Primary Examiner* — Jacob K Ackun
*Assistant Examiner* — Jenine Pagan
(74) *Attorney, Agent, or Firm* — McDonald Hopkins LLC

(57) ABSTRACT

A display package includes a container that defines a first row between a base panel and a first top panel and a second row between the base panel and the second top panel. A first article set is disposed within the first row. A backing card is coupled to the container to define an interior volume including the first and second rows. A flap of the backing card extends into the interior volume at a predetermined angle. A top edge of the flap is positioned between the base panel and the second top panel. A second article set is disposed within the second row and is secured between the top edge and the second top panel. The second article set is positioned higher than the first article set, such that sides of the second article set are visible over the first set of articles.

20 Claims, 6 Drawing Sheets

BLISTER PACKAGE WITH TIERED ROWS OF PRODUCTS

FIELD OF THE INVENTION

The present invention generally relates to packages for displaying product for sale, and more particularly, to a display package having a combined display card and container for containing product for display to consumers.

BACKGROUND OF THE INVENTION

Typically, the common practice for displaying small and lightweight retail items, such as batteries, cosmetics, toys, hardware items and the like, is to package the items in thermoformed blister packages and place the packages on shelves or hang the packages on hooks on various display racks. Conventional battery packages include a display card which provides a generally stiff, supportive backing, usually composed of cardboard, and a thermoformed polymeric blister that is bonded to the display card. The display card provides for displaying the merchandise for sale and contains print with suitable indicia such as advertising and instructions. The thermoformed blister generally includes a clear polymeric material, e.g., plastic, that, together with the display card, defines a cavity, generally having a shape to fit over and cover the products contained within a package. The blister isolates the products from the purchaser and prevents inadvertent damage that can result from repeated handling prior to sale, while further allowing for the orderly display of products for sale to purchasers.

With battery display packages, batteries of the same size are commonly made available to consumers for purchase in a package containing a predetermined number of batteries. The batteries are displayed and sold in blister-type packages which usually contain four, eight, sixteen, or twenty batteries, and other numbers of batteries, commonly packaged in each display package. According to one approach, the blister is heat-sealed on one side of the cardboard display card. According to another approach, the display card is made of two layers of cardboard with an aperture formed in one of the cardboard layers. The polymeric blister typically has a peripheral flange that is disposed (and optionally glued) between the two layers of cardboard of the display card. Additionally, each display package typically has a through-hole formed in the display card near the top so that the package can be hung on a hook on a display stand in a retail store for display to consumers. The packages containing larger numbers of batteries can include multiple through-holes within the display card of the package where additional support may be beneficial. Within many packages, multiple sets of batteries can be positioned within the cavity defined between the display card and the blister. Generally, where multiple batteries are disposed within the same package, such as packages containing eight, ten, sixteen or more batteries, the batteries are positioned in two or more sets within the cavity of the display package. Generally, display packages having larger numbers of batteries include packages containing smaller types of batteries, such as AAA(R03)-, AA(R6)-size batteries, and the like, although large packs of larger batteries can be provided.

It is desirable to provide a display package that provides visibility for a back row of product to be displayed above a front row of product, where multiple rows of products, such as batteries, are disposed within a single display package. It is also desirable to create a package that provides this added visibility to a back row of product without creating a display package that includes geometries that may be cost-prohibitive or otherwise uneconomical to manufacture.

SUMMARY OF THE INVENTION

The above advantages are provided by a display package for retaining two rows of articles in a tiered configuration, according to the present invention.

According to a first aspect of the present invention is a display package for retaining two sets of articles. The package includes a container having a base panel, a first top panel and a second top panel, where the container defines a first row between the base panel and the first top panel and a second row between the base panel and the second top panel, wherein the second top panel is positioned farther from the base panel than the first top panel. The package also includes a first set of articles disposed at least partially within the first row and at least partially secured between the base panel and the first top panel. A backing card having a first surface is coupled to the container to define an interior volume, wherein the interior volume includes the first and second rows, and wherein the second row is at least partially defined by the first surface. The display package also includes a flap defined within the backing card and extending into the interior volume at a predetermined angle, wherein a top edge of the flap is positioned between the base panel and the second top panel. The display package further includes a second set of articles disposed within the second row, wherein the second set of articles is at least partially secured within the second row, between the top edge of the flap and second top panel. The second set of articles is positioned higher relative to the base panel than the first set of articles, such that the sides of the second set of articles are visible from a front of the package.

Embodiments of the first aspect of the invention can include any one or a combination of the following features:

- The flap is hingedly coupled to the backing card;
- The flap is coupled to the backing card via a living hinge;
- The container is substantially transparent and includes an outer flange that engages the backing card, and wherein the container is free of engagement with the flap;
- The backing card includes a perforated section proximate the second set of articles;
- The top edge of the flap supports the second set of articles from below when the package is placed in an upright configuration;
- The articles in the first and second set of articles are batteries; each of the batteries of the first and second sets of batteries can be cylindrical, have a length of between approximately 48 millimeters to approximately 52 millimeters and have a diameter of between approximately between 13 millimeters to approximately 15 millimeters; each of the batteries of the first and second sets of batteries can be cylindrical, have a length of between approximately 43 millimeters to approximately 46 millimeters and have a diameter of between approximately 10 millimeters to approximately 11 millimeters;
- The flap is substantially fixed at the predetermined angle;
- The base panel and first top panel define a front portion having a first height, and the base panel and second top panel define a rear portion having a second height that is greater than the first height;
- The package includes more than one flap within the backing card and extending into the interior volume; and
- The container includes a plurality of sides partially defining the interior volume; the plurality of sides can include a planar bottom panel extending along co-planar bases of the first and second rows.

A second aspect of the present invention includes a display package for retaining articles, the package including a container having a base panel and defining a front portion having a first height and a rear portion having a second height, wherein the second height is greater than the first height, and wherein the base panel at least partially defines the front and rear portions. The package also includes a backing card having a first surface coupled to the container to define an interior volume, wherein the interior volume includes the front and rear portions, the rear portions being partially defined by the first surface. The package further includes at least one flap defined within the backing card and extending into the rear volume at a predetermined angle. A top edge of each at least one flap is positioned between the base panel and the rear top of the rear portion. The distance between the base panel and a front top panel of the front portion is substantially the same as the distance from the top edge of the at least one flap to a rear top panel of the rear portion.

Embodiments of the second aspect of the invention can include any one or a combination of the following features:

The at least one flap is hingedly coupled to the backing card;

The at least one flap is coupled to the backing card via a living hinge;

The container is substantially transparent and includes an outer flange that engages the backing card, and wherein the container is free of engagement with the at least one flap;

The backing card includes a perforated section proximate the rear portion of the interior volume;

The at least one flap is substantially fixed at the predetermined angle; and

The display package is for retaining batteries.

A further aspect of the present invention is a display package for retaining two sets of articles. The package includes a container defining an interior volume having a plurality of sides partially defining front and rear portions of the interior volume, wherein the plurality of sides includes a planar bottom panel extending along a base of the front and rear portions. The package also includes a backing card having a first side coupled to the container, wherein the backing card at least partially defines the rear portion. The package further includes at least one flap defined within the backing card, wherein the at least one flap is angled relative to the backing card at a predetermined angle, and wherein a top edge of the at least one flap extends into the rear portion of the interior volume. The package also contains a first set of articles each having a first base and disposed at least partially in the front portion, wherein the first base is disposed proximate the bottom panel. The package further includes a second set of articles each having a second base and disposed in the rear portion, wherein the second base is disposed proximate the top edge of the at least one flap and distal from the bottom panel, wherein the second set of articles is positioned farther from the bottom panel than the first set of articles.

Embodiments of this further aspect of the invention can include any one or a combination of the following features:

Wherein the at least one flap is coupled by a living hinge to the backing card;

The first set of articles is free of engagement with the at least one flap;

The top edge of the at least one flap supports the second set of articles from below when the package is placed in an upright configuration, and wherein the second set of articles is positioned higher within the interior volume than the first set of articles such that an upper portion of the second set of articles is visible above the first set of articles from a front of the package;

The at least one flap is substantially fixed at the predetermined angle; and

The display package is for retaining batteries.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
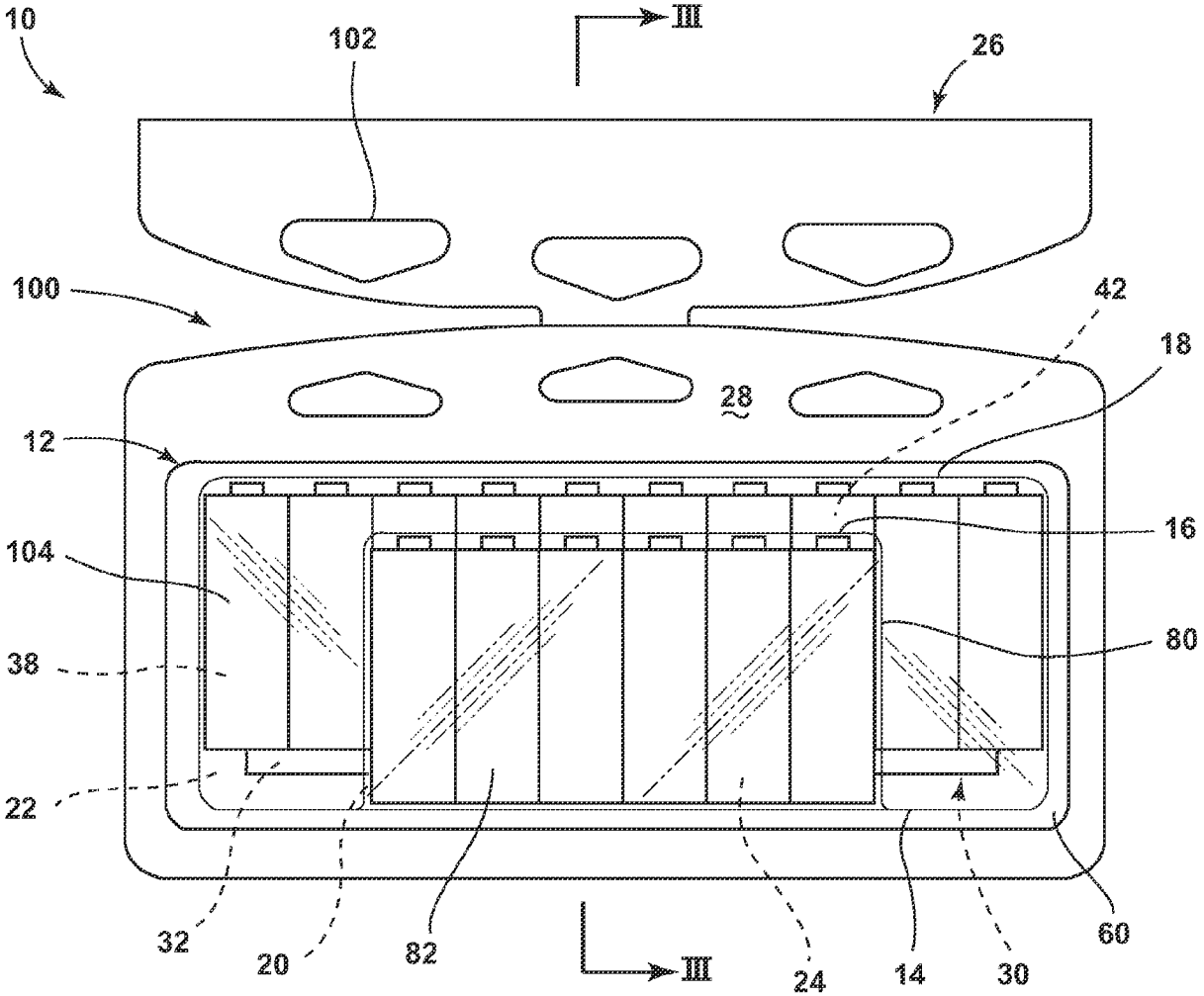
FIG. 1 is a front elevational view of one embodiment of the display package showing the tiered configuration of the first and second sets of articles.
Figure 2:
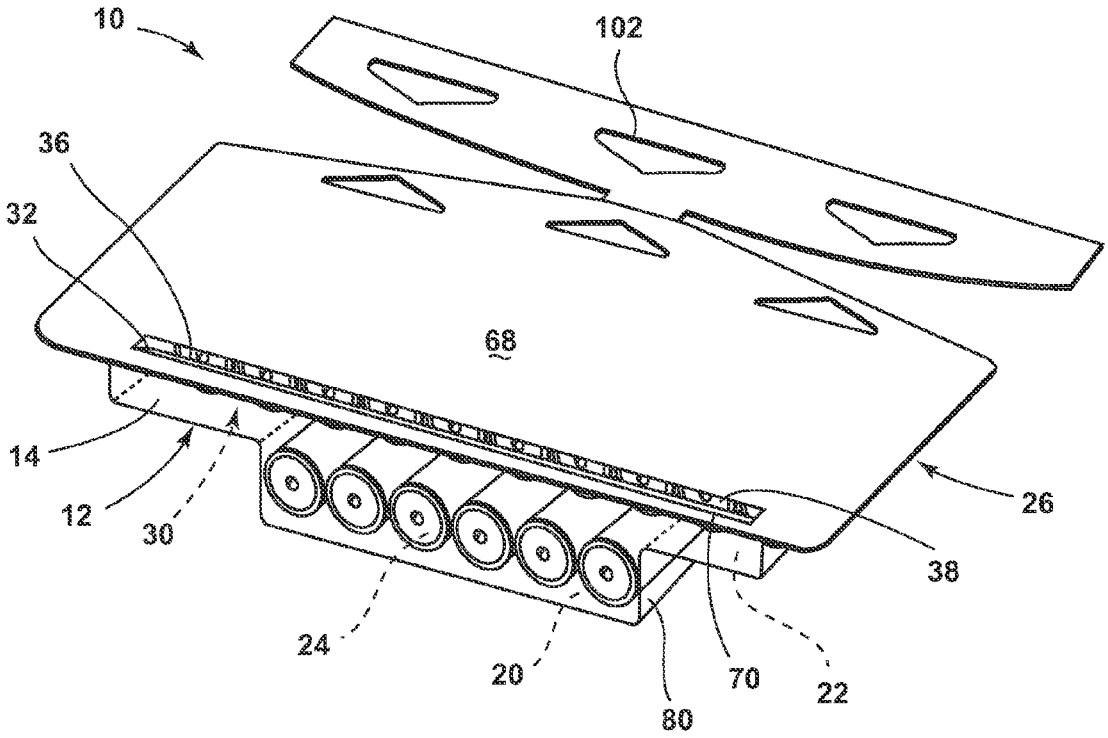
FIG. 2 is a rear bottom perspective view of the display package of FIG. 1.

As shown in FIGS. 1-5, reference numeral 10 generally refers to a display package for retaining at least two sets of articles, such as batteries, cosmetics, toys, hardware items and the like. The package 10 includes a container 12 having a base panel 14, a first top panel 16, and a second top panel 18. The container 12 defines a first row 20 between the base panel 14 and first top panel 16, and a second row 22 between the base panel 14 and the second top panel 18. The second top panel 18 is positioned farther from the base panel 14 than the first top panel 16. A first set of articles 24 is disposed at least partially within the first row 20 and is at least partially secured between the base panel 14 and first top panel 16. A backing card 26 having a first surface 28 is coupled to the container 12 to define an interior volume 30, wherein the interior volume 30 includes the first and second rows 20, 22. The second row 22 is at least partially defined by the first surface 28 of the backing card 26. A flap 32 is defined within the backing card 26 and extends into the interior volume 30 at a predetermined angle 34, wherein a top edge 36 of the flap 32 is positioned between the base panel 14 and the second top panel 18. A second set of articles 38 is disposed in the second row 22, wherein the second set of articles 38 is at least partially secured within the second row 22 between the top edge 36 of the flap 32 and the second top panel 18. The second set of articles 38 is positioned higher relative to the base panel 14 than the first set of articles 24, such that the sides 42 of the second set of articles 38 are visible over the first set of articles 24 from a front 44 of the package 10.

In the example illustrated in FIGS. 1-4, the container 12 is substantially transparent and includes an outer flange 60 that engages the backing card 26. It is contemplated that the outer flange 60 of the container 12 can be glued directly to the first surface 28 of the backing card 26, thereby securing the container 12 to the backing card 26 to form the interior volume 30 and also to secure the first and second sets of articles 24, 38 within the respective first and second rows 20, 22 of the interior volume 30. In various alternate embodiments, the backing card 26 can include first and second layers that are glued together to form a singular backing card 26. In such an embodiment, the outer flange 60 of the container 12 can be disposed between the first and second layers of the backing card 26. In embodiments incorporating a two-layer backing card 26, one of the layers can include an aperture into which the outer flange 60 can be disposed such that the outer flange 60 of the container 12 can be positioned between the first and second layers of the backing card 26 to be secured therein. In either of these embodiments. It is contemplated that the container 12 is free of engagement with the flap 32. In this regard, when the flap 32 is positioned at the predetermined angle 34, the flap 32 is entirely disposed within the second row 22 of the interior volume 30.

Referring again to FIGS. 2-4, the flap 32 of the backing card 26 is shown in one embodiment as a generally rectangular member that is hingedly coupled to the backing card 26. It is contemplated that the flap 32 can be coupled to the backing card 26 via a living hinge 70. In this manner, the flap 32 can be formed by angling a portion of the backing card 26 inward towards the interior volume 30 defined between the container 12 and the backing card 26 to form the flap 32. It is contemplated that the flap 32 is substantially fixed at the predetermined angle 34 to provide support, from below, for the second set of articles 38. The flap 32 can be formed by several methods that can include, but are not limited to, punching, cutting, perforating, or otherwise separating two, three, or more edges of an inner portion 68 of the backing card 26 to form the flap 32 and living hinge 70. It is contemplated that in various embodiments, a separate member can be attached to the backing card 26 to form the flap 32 that extends within the second row 22 of the interior volume 30. In such an embodiment, the member that is attached to the backing card 26 to form the flap 32 can include a living hinge 70 or can be formed to include the predetermined angle 34, such that when the member is attached to the backing card 26, the flap 32 is attached to the backing card 26 already disposed at the predetermined angle 34.

Referring again to FIGS. 1-4, the first set of articles 24 can be disposed within the first row 20 of the interior volume 30 positioned within a front portion of the interior volume 30. In this manner, the first set of articles 24 is disposed between the base panel 14 and the first top panel 16. Once disposed therein, the first set of articles 24 are afforded very limited movement within the first row 20, such that the first set of articles 24 is substantially held in place, between the base panel 14, the first top panel 16, two front-side panels 80, and a primary front panel 82.

In various embodiments, the first and second sets of articles 24, 38 can be positioned within the interior volume 30 in an in-line configuration, such that the articles of the first set 24 are substantially in-line with the articles of the second set 38, perpendicular to the backing card 26. In such configurations, it is contemplated that the first set of articles 24 is completely disposed within the first row 20 of the interior volume 30 such that the first set of articles 24 is substantially contained only within the first row 20 and the second set of articles 38 is substantially contained only in the second row 22 which is positioned within a rear portion of the interior volume 30. In various alternate embodiments, the first and second sets of articles 24, 38 can be disposed within the interior volume 30 in a staggered configuration, such that the first set of articles 24 is disposed at least partially between a portion of the second set of articles 38, and vice versa. In such a configuration, it is contemplated that the first set of articles 24 is only partially contained within the first row 20 and the first set of articles 24 extends at least partially into the second row 22 of the interior volume 30. The second set of articles 38 in the staggered configuration is entirely contained within the second row 22 of the interior volume 30 to account for the vertically-stepped configuration of the first and second sets of articles 24, 38, where the second set of articles 38 is positioned higher within the interior volume 30 than the first set of articles 24, as will be described more fully below.

Referring again to FIGS. 1-4, the base panel 14 of the container 12 is a single coplanar member that extends underneath both the first row 20 and the second row 22 of the interior volume 30. In this manner, the base panel 14 of the container 12 extends substantially perpendicular from the backing card 26 to the primary front panel 82 of the container 12. In various embodiments, it is contemplated that the number of articles in the first set of articles 24 may not be equal to the number of articles in the second set of articles 38 such that one of the first and second rows 20, 22 may be wider than the other of the first and second rows 20, 22. In such embodiments, the base panel 14 is configured to be formed to account for the configurations of the first and second sets of articles 24, 38 in the particular display package 10. By way of example, and not limitation, the illustrated embodiment includes sixteen batteries, where the first set of articles 24 includes six batteries and the second set of articles 38 includes ten batteries. In this embodiment, the base panel 14 at the second row 22 is wider than the base panel 14 at the first row 20, however, the base panel 14 includes a single planar member that extends from the first surface 28 of the backing card 26 to the primary front panel 82 of the container 12. It is contemplated that the first and second sets of articles 24, 38, in this example, batteries, may contain equal numbers of batteries or other articles such that the base panel 14 is substantially rectangular.

Referring again to FIGS. 1-4, the second set of articles 38 is disposed within the second row 22 of the interior volume 30, such that a bottom surface of each of the second set of articles 38 rests upon the top edge 36 of the flap 32, unlike the first set of articles 24 which rests upon the base panel 14. In this manner, the second set of articles 38 is substantially retained between the top edge 36 of the flap 32 and the second top panel 18 of the container 12. In the various configurations, the second top panel 18 is positioned farther from the base panel 14 than the first top panel 16. The extra distance provided between the base panel 14 and the second top panel 18 affords the second set of articles 38 space to be positioned between the top edge 36 of the flap 32 and the second top panel 18. According to this configuration, because the second set of articles 38 rests upon the flap 32 rather than the base panel 14, the second set of articles 38 is positioned higher, relative to the base panel 14, than the first set of articles 24. In this manner, when the display package 10 is viewed from the front 44 of the package 10, an upper portion of the sides 42 of the second set of articles 38 is visible above the first set of articles 24, thereby creating a tiered configuration of the first and second sets of articles 24, 38 within the display package 10. This configuration allows a consumer to more easily view the number of articles within a package 10, since at least a portion of each article is readily visible when viewed from the front 44 of the display package 10 (as viewed in FIG. 1).

Figure 3:
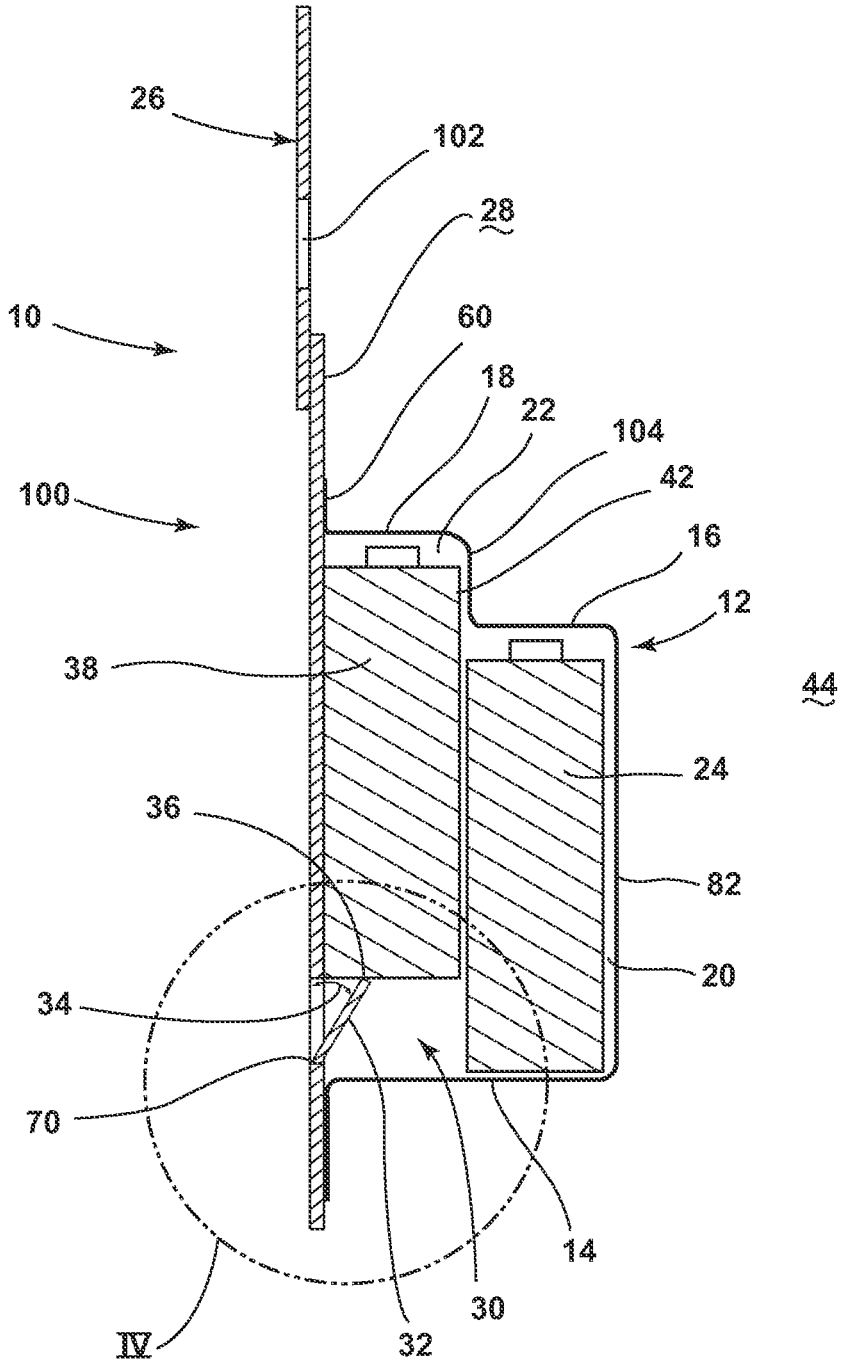
FIG. 3 is a cross-sectional view of the display package of FIG. 1, taken at line III-III.
Figure 4:
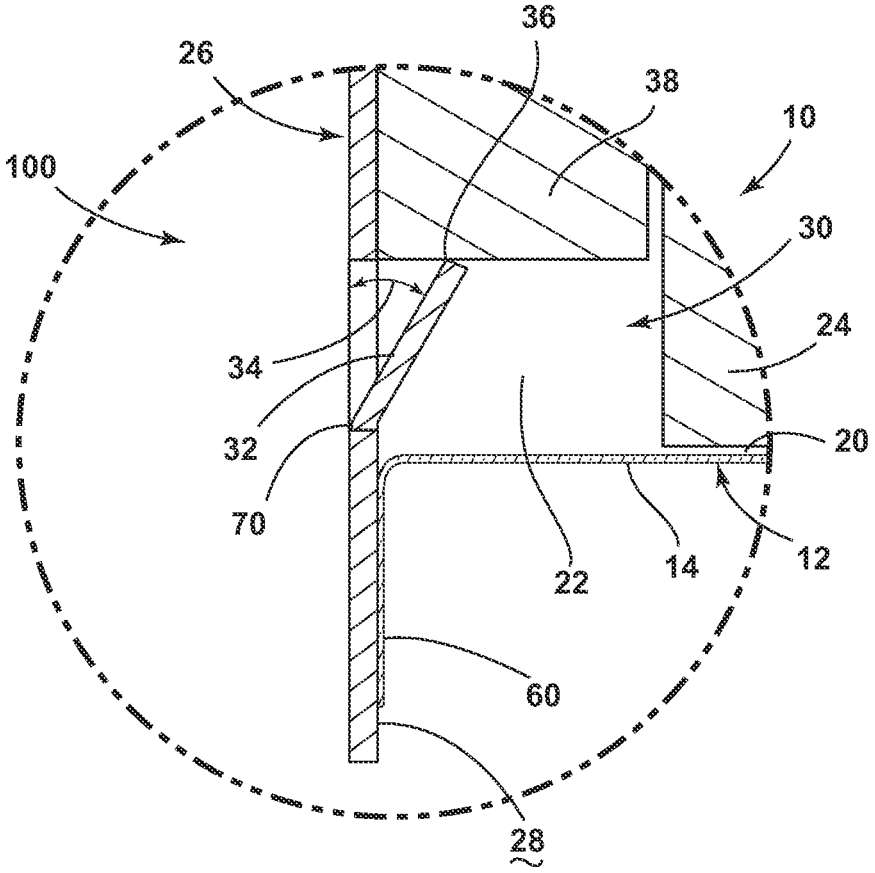
FIG. 4 is a detailed cross-sectional view of the embodiment of FIG. 3, taken at area IV.

Referring now to FIGS. 3 and 4, it is contemplated that the predetermined angle 34 can vary based upon a plurality of factors. Such factors can include, but are not limited to, the type of articles disposed in the display package 10, the number of articles in the second set of articles 38, the size of the flap 32 that is disposed at the predetermined angle 34 and other factors. By way of example, and not limitation, where a larger article type makes up the second set of articles 38, the flap 32 may be positioned at a more acute predetermined angle 34 relative to the backing card 26 in order to provide more vertical support from below. Alternatively, where a smaller article type makes up the second set of articles 38, a greater predetermined angle 34 may be implemented based upon various factors and considerations.

Referring again to FIGS. 1-4, when the display package 10 is placed in an upright configuration 100, such that a through-hole 102 of the display package 10 is above the base panel 14, the backing panel is substantially vertical, and the base panel 14 is substantially level, the top edge 36 of the flap 32 is configured to support the second set of articles 38 from below. The second set of articles 38 is also contained and supported from above by the second top panel 18. Lateral support for the second set of articles 38 is provided by the backing card 26 from one side 42 and by at least an intermediate-front panel 104 of the container 12, where the intermediate-front panel 104 is positioned substantially parallel with and between the backing card 26 and the primary front panel 82 of the container 12. At least a portion of the second set of articles 38 is laterally supported by a portion of the first set of articles 24, and, in turn, at least a portion of the first set of articles 24 are laterally supported by at least a portion of the second set of articles 38. In this manner, the first and second sets of articles 24, 38 are substantially secured within the first and second rows 20, 22 of the interior volume 30 such that the first and second sets of articles 24, 38 are substantially limited in their movement within the interior volume 30.

Referring again to FIGS. 1-4, several types of articles can be disposed within the display package 10, including, but not limited to, AAA(R03), AA(R6), C(R14), D(R20), 9-volt (e.g., 6LR61), and other sizes or types of batteries, as well as toys, cosmetics, hardware, and the like. By way of example, and not limitation, it is contemplated that the first and second sets of articles 24, 38 can be AA (R6) batteries can be displayed within the display package 10, where each of the batteries of the first and second sets of articles 24, 38 is cylindrical, has a length of between approximately 48 millimeters to approximately 52 millimeters, and has a diameter of between approximately 13 millimeters to approximately 15 millimeters. Alternatively, the first and second sets of articles 24, 38 can be AAA (R03) batteries displayed within the display package 10 where each of the batteries of the first and second sets of articles 24, 38 is cylindrical, has a length of between approximately 43 millimeters to approximately 46 millimeters and has a diameter between approximately 10 millimeters to approximately 11 millimeters. As stated above, other types of articles or combinations of articles can be displayed within a single display package 10. In various embodiments, it is contemplated that more than one type of article can be included in the same package 10, wherein a first set of articles 24 includes one type of article, and a second set of articles 38 includes a second type of article.

Referring once again to FIGS. 1-4, the configuration of the container 12 and the backing card 26 for the display package 10 is configured to allow for the tiered display configuration of the first and second sets of articles 24, 38 without requiring complex geometries to be formed within the container 12. Because the base panel 14 of the container 12 is a planar piece extending substantially perpendicular from the backing card 26 and the first and second top panels 16, 18 of the container 12 include a stepped configuration, the blister forming the container 12 can be made through a single pressing or sealing operation that may not require subsequent outward or expanding operations that may make formation of the container 12 substantially more complex than the configuration of the container 12 as discussed above.

In the various embodiments, the container 12 that forms the blister can be made from various materials that are at least partially translucent or transparent which can include, but are not limited to, PVC, polyethylene terephthalate (PET), or other substantially clear plastic-type material that can be formed into a blister to form the container 12.

Figure 5:
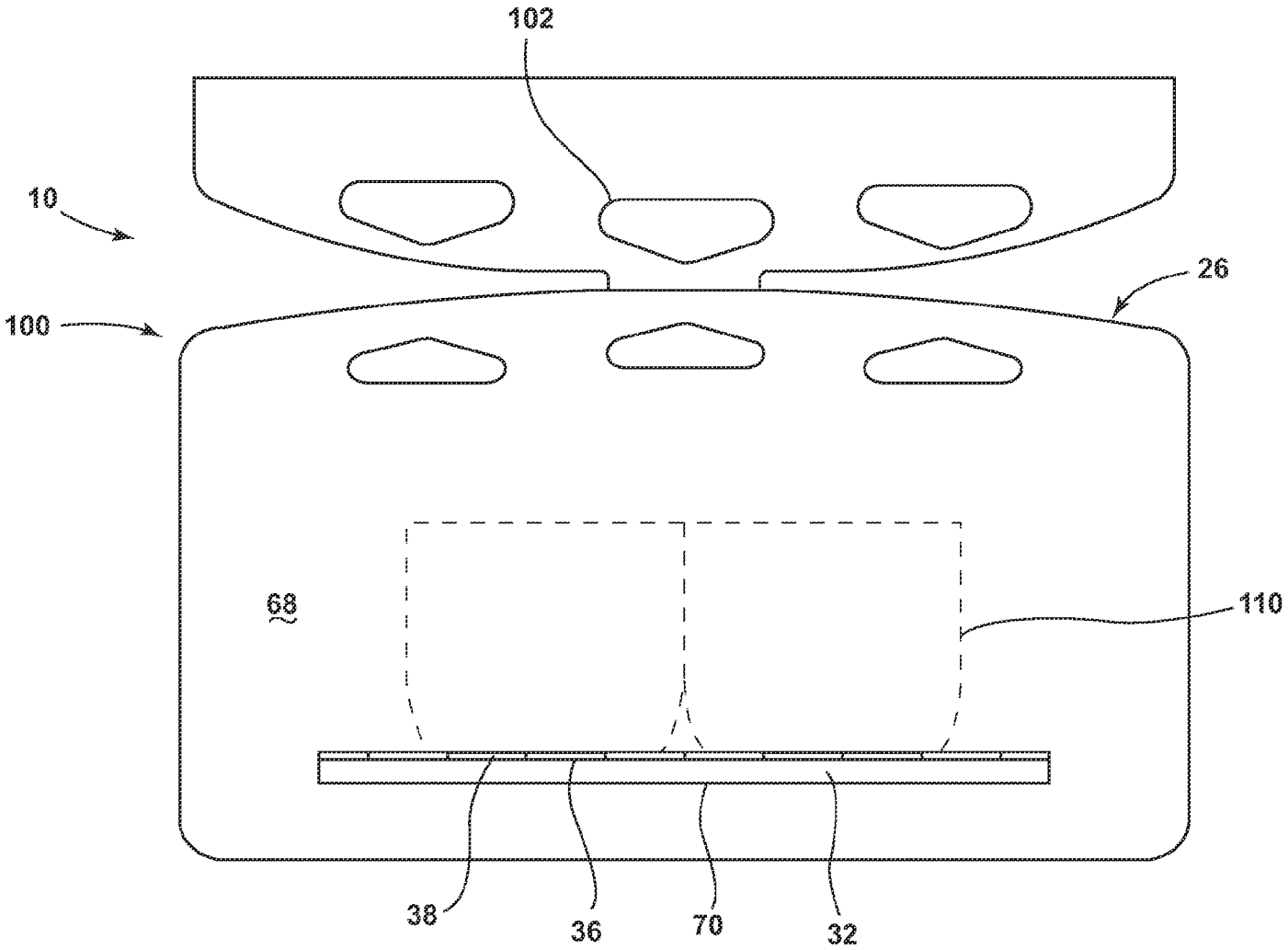
FIG. 5 is a rear elevational view of an alternate embodiment of the display package.

Referring now to FIG. 5, it is contemplated that in various embodiments, the backing board can be a substantially rectangular piece of cardboard. However, it is contemplated that the backing board could have other shapes and could be made out of any material, such as other paper products, plastic, combinations thereof, as well as other materials. The backing card 26 can also include various perforations 110 extending along at least a portion of the backing card 26 and dividing the backing card 26 into various sections. It is contemplated that one or more of the sections can include a finger aperture adjacent to one or more of the perforations 110 for allowing a user of the display package 10 to place their finger into the finger aperture and pull one or more of the perforated sections away from the backing card 26 in order to access the interior volume 30 of the display package 10 to remove one or more of the articles. It should be understood that in the various embodiments, the backing card 26 may be free of perforations 110.

In the various embodiments, it is contemplated that the display package 10 can include three or more sets of articles where the rearmost set rests upon a shelf created by the top edge 36 of the flap 32 disposed at the predetermined angle 34. It is also contemplated that various embodiments can include more than one flap 32 disposed at different heights, where the second set of articles 38 (or rearmost set of articles, in the case of a display package 10 with more than two sets of articles), are maintained within the rear row of the display package 10 at varying heights due to the different heights of the various flaps 32 defined within the backing card 26. It is contemplated that separate flaps may be used to support different types of articles disposed within the second row 22 of the display package 10. It is also contemplated that the positioning of the flap 32, or plurality of flaps 32, can vary depending on the desired distance that the second set of articles 38 extends above the first set of articles 24.

Figure 6:
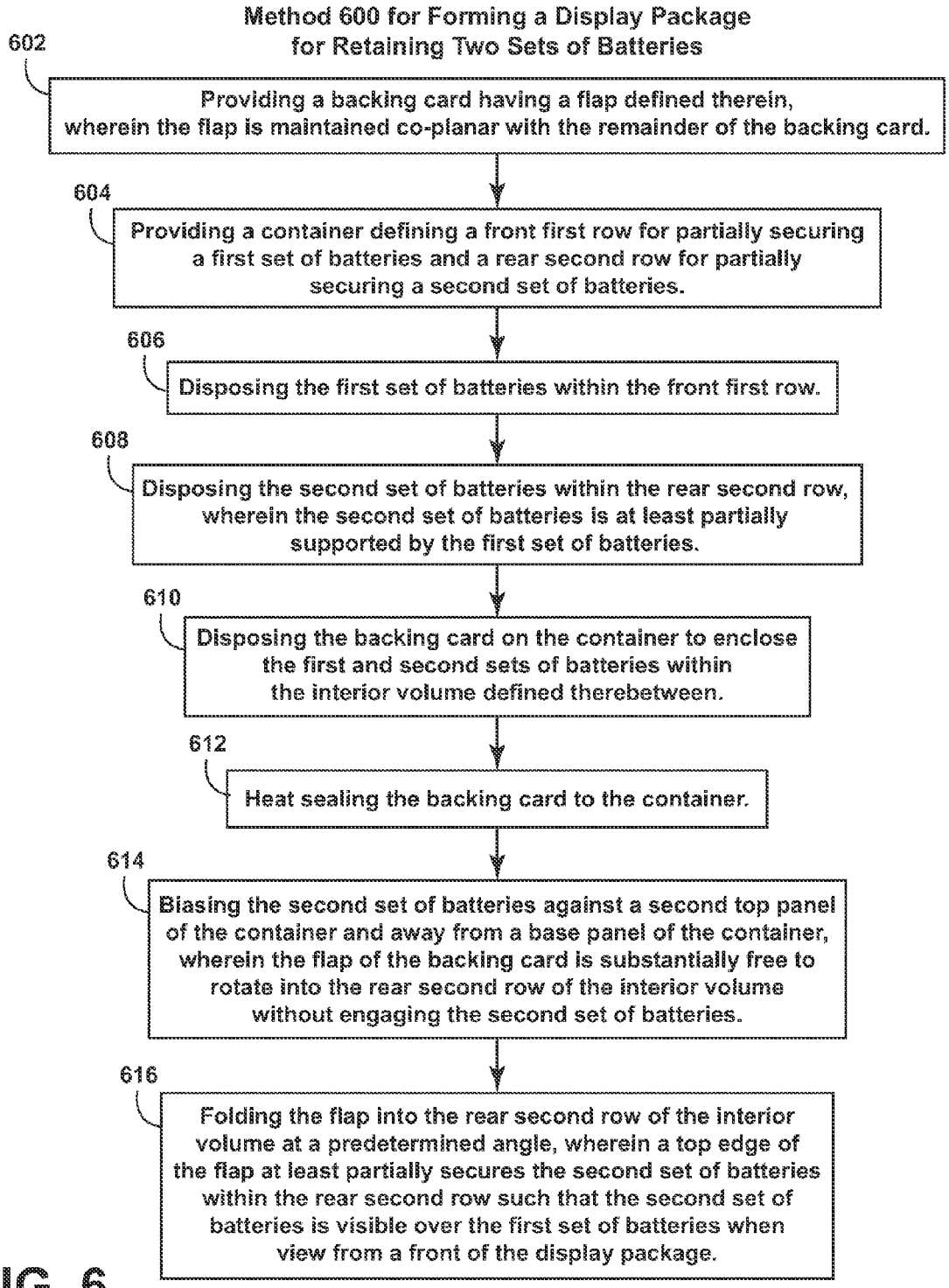
FIG. 6 is a schematic flow diagram illustrating one embodiment of a method for forming a display package.

Referring now to FIG. 6, having substantially described the various embodiments of the display package 10, a method 600 is disclosed for forming a display package 10 by retaining two sets of articles. A first step of the method 600 is forming a backing card 26 for the display package 10, wherein the backing card 26 includes at least one flap 32 defined within a portion of the backing card 26 (step 602). During manufacture, a plurality of backing cards 26 can be formed on a single sheet. Alternatively, individual backing cards 26 can be manufactured. During formation of each of the backing cards 26, two, three or more sides 42 of the flap 32 are defined within an inner portion 68 of the backing card 26 by cutting, punching, or otherwise separating the sides 42 of the flap 32 from the remainder of the backing card 26. While the flap 32 can be defined during this stage of manufacture, the flap 32 is not necessarily moved into the predetermined angle 34. Rather, in the various embodiments, the flap 32 is maintained coplanar with the remainder of the backing card 26 during this stage of manufacture, such that the plurality of cards can be stacked for delivery without the flap 32 of one card becoming entangled with an aperture left by the flap 32 of another card, thereby causing two or more cards to stick together and prevent easy distribution during the packaging process. During the formation of the backing cards 26, the perforations 110 can also be added, if desired.

Referring again to FIG. 6, another step of the method 600 includes forming a container 12 having a blister that defines at least a portion of the first and second rows 20, 22 of the interior volume 30 of the display package 10 (step 604). The blister of the container 12 can be formed in one of several methods, including, but not limited to, heat stamping, heat forming, cold pressing, or other similar methods that can be used to form the blister of the container 12. Once the container 12 is formed, the first set of articles 24 is disposed within the first row 20 of the interior volume 30 to substantially fill the first row 20 (step 606). As discussed above, the first set of articles 24 is substantially secured between the base panel 14 and the first top panel 16 of the container 12, such that the first set of articles 24 is afforded very limited movement between the first row 20. Once the first set of articles 24 is disposed within the first row 20, the second set of articles 38 is disposed within the second row 22, where the second set of articles 38 are at least partially supported by the first set of articles 24, within the second row 22 of the interior volume 30 of the container 12 (step 608).

After disposing the first and second sets of articles 24, 38 within the container 12, the backing card 26 is disposed onto the outer flange 60 of the container 12 (step 610). In this manner, the flap 32 of the backing card 26, while still co-planar with the backing card 26, is positioned within the boundary of the interior volume 30 of the package 10. Once the backing card 26 is positioned, the backing card 26 and container 12 are heat-sealed together by a first heat seal (step 612). Because the flap 32 is not yet moved into the predetermined angle 34, the second set of articles 38 is not secured within a second row 22 and is allowed to slide between the base panel 14 and the second top panel 18 as the distance between these two panels is greater than the height of each of the articles of the second set of articles 38.

Referring again to FIG. 6, once the first and second sets of articles 24, 38 are disposed within the first and second rows 20, 22 of the interior volume 30 of the container 12, the second set of articles 38 is biased away from the base panel 14, such that a top surface of each of the second set of articles 38 engages the second top panel 18 of the container 12 (step 614). This biasing force can be accomplished by any one of various methods, that can include, but are not limited to, moving the second set of articles 38 by hand, shifting the package 10 at an angle such that the second set of articles 38 is moved by gravity toward the second top panel 18, using a magnet to attract the top surfaces of each of the second set of articles 38 toward the second top panel 18, as well as other methods. Once the second set of articles 38 is disposed against the second top panel 18 of the container 12, the second set of articles 38 is positioned above the flap 32 defined within the backing card 26, such that the flap 32 can be moved to the predetermined angle 34 without substantially engaging and potentially damaging the second set of articles 38. It is contemplated that, in various embodiments, the second set of articles 38 are first biased as in step 614, then the backing card 26 is placed on the package 10 to be heat-sealed.

After the second set of articles 38 is positioned, a second heat seal moves the flap 32 into place by pushing, punching, or otherwise manipulating the flap 32 into the predetermined angle 34 (step 616). It is contemplated that a single heat sealing station can be used to seal the backing card 26 and the container 12 together and also manipulate the flap 32 into the predetermined angle 34. When the heat sealing station moves the flap 32 into the predetermined angle 34, heat from the heat sealing station places the flap 32 in the substantially fixed position at the predetermined angle 34. In this manner, the top edge 36 of the flap 32 forms a shelf within the second row 22 of the interior volume 30 upon which the second set of articles 38 can rest when the display package 10 is placed in an upright position.

While the invention has been described in detail herein in accordance with certain preferred embodiments thereof, many modifications and changes therein may be affected by those skilled in the art without departing from the spirit of the invention. Accordingly, it is our intent to be limited only by the scope of the appending claims and not by way of the details and instrumentalities describing the embodiments shown herein.

What is claimed is:

1. A display package for retaining two sets of articles, said package comprising:

a container having a base panel, a first top panel and a second top panel, the container defining a first row between the base panel and first top panel and a second row between the base panel and the second top panel, wherein the second top panel is positioned farther from the base panel than the first top panel;

a first set of articles at least partially disposed within the first row and at least partially secured between the base panel and the first top panel;

a backing card having a first surface coupled to the container to define an interior volume, wherein the interior volume includes the first and second rows, and wherein the second row is at least partially defined by the first surface;

a flap defined within the backing card and extending into the interior volume at a predetermined angle, wherein a top edge of the flap is positioned between the base panel and the second top panel; and a second set of articles disposed within the second row, wherein the second set of articles is at least partially secured within the second row between the top edge of the flap and the second top panel, wherein the second set of articles is positioned higher relative to the base panel than the first set of articles, such that sides of the second set of articles are visible over the first set of articles from a front of the package.

2. The package of claim 1, wherein the flap is hingedly coupled to the backing card.

3. The package of claim 2, wherein the flap is coupled to the backing card via a living hinge.

4. The package of claim 1, wherein the container is substantially transparent and includes an outer flange that engages the backing card, and wherein the container is free of engagement with the flap.

5. The package of claim 1, wherein the backing card includes a perforated section proximate the second set of articles.

6. The package of claim 1, wherein the top edge of the flap supports the second set of articles from below when the package is placed in an upright configuration.

7. The package of claim 1, wherein the articles in the first and second sets of articles are batteries.

8. The package of claim 7, wherein each battery of the first and second sets of articles is cylindrical, has a length of between approximately 48 millimeters to approximately 52 millimeters, and has a diameter of between approximately 13 millimeters to approximately 15 millimeters.

9. The package of claim 7, wherein each battery of the first and second sets of articles is cylindrical, has a length of between approximately 43 millimeters to approximately 46 millimeters, and has a diameter of between approximately 10 millimeters to approximately 11 millimeters.

10. The package of claim 1, wherein the flap is substantially fixed at the predetermined angle.

11. A display package for retaining articles, the package comprising:

a container having a base panel and defining a front portion having a first height and a rear portion having a second height, wherein the second height is greater than the first height, and wherein the base panel at least partially defines the front and rear portions;

a backing card having a first surface coupled to the container to define an interior volume, wherein the interior volume includes the front and rear portions, the rear portion being at least partially defined by the first surface; and at least one flap defined within the backing card and extending into the rear portion at a predetermined angle, wherein a top edge of each at least one flap is positioned between the base panel and a rear top of the rear portion, and wherein the distance between the base panel and a front top of the front portion is substantially the same as the distance from the top edge of the at least one flap to a rear top of the rear portion.

12. The package of claim 11, wherein the at least one flap is hingedly coupled to the backing card.

13. The package of claim 12, wherein the at least one flap is coupled to the backing card via a living hinge.

14. The package of claim 11, wherein the container is substantially transparent and includes an outer flange that engages the backing card, and wherein the container is free of engagement with the at least one flap.

15. The package of claim 11, wherein the backing card includes a perforated section proximate the rear portion of the interior volume.

16. The package of claim 11, wherein the at least one flap is substantially fixed at the predetermined angle.

17. A display package for retaining two sets of articles, said package comprising:

a container defining an interior volume and having a plurality of sides partially defining front and rear portions of the interior volume, and wherein the plurality of sides includes a planar bottom panel extending along co-planar bases of the front and rear portions;

a backing card having a first side coupled to the container, wherein the backing card at least partially defines the rear portion;

at least one flap defined within the backing card, wherein the at least one flap is angled relative to the backing card at a predetermined angle, and wherein a top edge of the at least one flap extends into the rear portion of the interior volume;

a first set of articles each having a first base and disposed at least partially in the front portion, wherein the first base is disposed proximate the bottom panel; and a second set of articles each having a second base and disposed in the rear portion, wherein the second base is disposed proximate the top edge of the at least one flap and distal from the bottom panel, wherein the second set of articles is positioned farther from the bottom panel than the first set of articles.

18. The package of claim 17, wherein the at least one flap is coupled by a living hinge to the backing card.

19. The package of claim 17, wherein the first set of articles is free of engagement with the at least one flap, and wherein the at least one flap is substantially fixed at the predetermined angle.

20. The package of claim 17, wherein the top edge of the at least one flap supports the second set of articles from below when the package is placed in an upright configuration, and wherein the second set of articles is positioned higher within the interior volume than the first set of articles such that an upper portion of the second set of articles is visible above the first set of articles from a front of the package.

* * * * *